US011255553B2

(12) United States Patent
Hung et al.

(10) Patent No.: US 11,255,553 B2
(45) Date of Patent: Feb. 22, 2022

(54) VARIABLE REFRIGERANT FLOW SYSTEM WITH REHEATING OF DEHUMIDIFIED AIR

(71) Applicant: Lennox Industries, Inc., Richardson, TX (US)

(72) Inventors: Der-Kai Hung, Dallas, TX (US); Lin Lan, Colleyville, TX (US); Christopher John Drury, Frisco, TX (US)

(73) Assignee: Lennox Industries Inc., Richardson, TX (US)

( * ) Notice: Subject to any disclaimer, the term of this patent is extended or adjusted under 35 U.S.C. 154(b) by 186 days.

(21) Appl. No.: 16/550,446

(22) Filed: Aug. 26, 2019

(65) Prior Publication Data

US 2021/0063030 A1 Mar. 4, 2021

(51) Int. Cl.

| | |
|---|---|
| ***F24F 3/06*** | (2006.01) |
| ***F24F 11/84*** | (2018.01) |
| ***F25B 13/00*** | (2006.01) |
| ***F25B 41/20*** | (2021.01) |

(52) U.S. Cl.

CPC ..... *F24F 3/06* (2013.01); *F24F 11/84* (2018.01); *F25B 13/00* (2013.01); *F25B 41/20* (2021.01); *F25B 2400/0419* (2013.01)

(58) Field of Classification Search

CPC ... F24F 11/84; F24F 3/06; F25B 13/00; F25B 2400/0419; F25B 41/20

See application file for complete search history.

(56) References Cited

U.S. PATENT DOCUMENTS

| | | | | |
|---|---|---|---|---|
| 7,275,384 | B2 * | 10/2007 | Taras | F24F 3/153 62/159 |
| 7,287,394 | B2 * | 10/2007 | Taras | F24F 3/153 62/159 |
| 2012/0272669 | A1 * | 11/2012 | Blanton | F24F 1/00077 62/89 |
| 2015/0013356 | A1 * | 1/2015 | Karkhanis | F25B 49/02 62/90 |
| 2018/0231293 | A1 * | 8/2018 | Blanton | F25B 49/027 |
| 2020/0309394 | A1 * | 10/2020 | Blanton | F25B 49/02 |

* cited by examiner

*Primary Examiner* — Henry T Crenshaw
(74) *Attorney, Agent, or Firm* — Baker Botts L.L.P.

(57) ABSTRACT

An apparatus includes a compressor, a first heat exchanger, a reheater, a first valve, a second heat exchanger, and a blower. The compressor compresses a refrigerant. The blower moves air proximate the second heat exchanger to the reheater. During a first mode of operation: the first heat exchanger removes heat from a first portion of the refrigerant from the compressor, the first valve opens such that a second portion of the refrigerant from the compressor flows to the reheater, the second heat exchanger uses the first portion of the refrigerant from the first heat exchanger and the second portion of the refrigerant from the reheater to cool air proximate the second heat exchanger, and the reheater uses the second portion of the refrigerant from the compressor to heat the air moved by the blower.

16 Claims, 6 Drawing Sheets

VARIABLE REFRIGERANT FLOW SYSTEM WITH REHEATING OF DEHUMIDIFIED AIR

TECHNICAL FIELD

This disclosure relates generally to a variable refrigerant flow (VRF) system.

BACKGROUND

VRF systems may cycle a refrigerant to cool or heat various spaces.

SUMMARY

Variable refrigerant flow (VRF) systems cycle refrigerant to cool or heat various spaces. For example, a VRF system cycles refrigerant to cool or heat spaces near or around indoor heat exchangers (e.g., evaporators). These heat exchangers include metal components, such as coils, that carry the refrigerant. The refrigerant enters the heat exchangers and absorbs heat from or transfers heat to the air surrounding the heat exchangers, which cools or heats that air. That air is then circulated (e.g., by fan or blower) to various spaces to cool or heat those spaces. Each indoor heat exchanger can be placed in a particular zone (e.g., room) to cool or heat that room. Different indoor heat exchangers in different zones can operate in different modes (e.g., cooling or heating) at the same time.

An outdoor unit that includes an outdoor heat exchanger (e.g., condenser) and a compressor adjusts the heat content in the refrigerant and the flow of the refrigerant depending on the needs of the system. The refrigerant from the indoor heat exchangers is directed through the outdoor unit and back to the indoor heat exchangers. In the outdoor unit, the outdoor heat exchanger and the compressor work to remove heat from or add heat to the refrigerant. The refrigerant is then cycled back to the indoor heat exchanger to cool or heat the space. In certain installations, one outdoor unit can service several indoor heat exchangers that cool or heat different zones. The components of the system (e.g., outdoor heat exchanger, indoor heat exchanger, and compressor) can vary the flow of the refrigerant through the system depending on the cooling and heating needs. For example, if only one zone is active, the refrigerant flow may be low. If several zones are active, the refrigerant flow may increase. In this manner, different zones can be cooled and/or heated without installing duct work throughout a structure.

In some installations, the air that is cooled or heated by the indoor heat exchanger is external air that is supplied to the system. For example, the VRF system may cool or heat air drawn from outside a building and circulate that air throughout the building. At the same time, the VRF system may eject air from inside the building out of the building. In this manner, the air within the building is refreshed and the air pressure within the building is controlled.

In some instances, to control a humidity level within a building or space, the indoor heat exchanger is also used to reduce a humidity level of the external air drawn by the system. For example, the indoor heat exchanger may cool the air to condense water vapor in the air, thereby removing moisture from the air. The more the air is cooled, the more water vapor can be removed from the air. However, in some environments, reducing the humidity level of the air may cause the air to be overcooled. For example, when the temperature of the external air drawn by the system is sufficiently cool, further cooling that air to reduce the humidity level of that air may cause that air to be colder than needed or desired. Circulating that air throughout a space may cause the space to become colder than desired.

In certain installations, the overcooled air is reheated to a suitable or desired temperature before that air is circulated throughout a space. The overcooled air is moved (e.g., by a blower) to a reheater. The reheater may use electric coils or refrigerant from a compressor or outdoor heat exchanger to heat the overcooled air. In these installations, however, it may be difficult to control the amount of reheating that occurs. In some instances, the reheated air may be too hot or too cold for the space. For example, as the same refrigerant flow passes through an indoor heat exchanger and the reheater in series, the net effect of the cooling capacity and heating capacity may cause the supply air to be too cold or too hot from the setpoint (e.g., the ratio of the cooling and heating capacities is fixed, but the supply air setpoint and the ambient may vary, which causes an offset between the supply air temperature and the setpoint). In this case, it is difficult to control the supply air temperature. In other cases, when dehumidification is still needed in mild ambient temperatures, the compressor may reach the low part load limit, the supply air may be too cold, or the reheater air may be too hot for the space.

This disclosure contemplates an unconventional VRF system that reheats overcooled air in a controlled manner. Generally, the VRF system controls a flow of refrigerant to a reheater depending on whether reheating is desired. During a first mode of operation when reheating is desired, a portion of hot refrigerant from a compressor is directed to the reheater, which is then used to heat overcooled air. During a second mode of operation when reheating is not desired, the hot refrigerant from the compressor is directed to an outdoor heat exchanger to remove heat from the refrigerant, as in a regular cooling cycle. The ratio of the two portions of refrigerant flows are regulated by a solenoid valve opening time percentage. In this manner, the reheating of overcooled air is controlled, which improves the comfort level of a space.

According to an embodiment, an apparatus includes a compressor, a first heat exchanger, a reheater, a first valve, a second heat exchanger, and a blower. The compressor compresses a refrigerant. The blower moves air proximate the second heat exchanger to the reheater. During a first mode of operation: the first heat exchanger removes heat from a first portion of the refrigerant from the compressor, the first valve opens such that a second portion of the refrigerant from the compressor flows to the reheater, the second heat exchanger uses the first portion of the refrigerant from the first heat exchanger and the second portion of the refrigerant from the reheater to cool air proximate the second heat exchanger, and the reheater uses the second portion of the refrigerant from the compressor to heat the air moved by the blower. During a second mode of operation: the first heat exchanger removes heat from the refrigerant from the compressor, the first valve closes to prevent refrigerant from the compressor from flowing to the reheater, and the second heat exchanger uses the refrigerant from the first heat exchanger to cool the air proximate the second heat exchanger.

According to another embodiment, a method includes compressing, by a compressor, a refrigerant. The method also includes, during a first mode of operation: removing, by a first heat exchanger, heat from a first portion of the refrigerant from the compressor, opening a first valve such that a second portion of the refrigerant from the compressor flows to a reheater, using, by a second heat exchanger, the first portion of the refrigerant from the first heat exchanger and the second portion of the refrigerant from the reheater to cool air proximate the second heat exchanger, moving, by a blower, air proximate the second heat exchanger to the reheater, and using, by the reheater, the second portion of the refrigerant from the compressor to heat air moved by the blower. The method further includes, during a second mode of operation: removing, by the first heat exchanger, heat from the refrigerant from the compressor, closing the first valve to prevent refrigerant from the compressor from flowing to the reheater, using, by the second heat exchanger, the refrigerant from the first heat exchanger to cool the air proximate the second heat exchanger, and moving, by the blower, air proximate the second heat exchanger to the reheater.

According to yet another embodiment, a system includes a compressor, a first heat exchanger, a reheater, a first valve, and a second heat exchanger. The compressor compresses a refrigerant. During a first mode of operation: the first heat exchanger removes heat from a first portion of the refrigerant from the compressor, the first valve opens such that a second portion of the refrigerant from the compressor flows to the reheater, the second heat exchanger uses the first portion of the refrigerant from the first heat exchanger and the second portion of the refrigerant from the reheater to cool air proximate the second heat exchanger, and the reheater uses the second portion of the refrigerant from the compressor to heat the air cooled by the second heat exchanger. During a second mode of operation: the first heat exchanger removes heat from the refrigerant from the compressor, the first valve closes to prevent refrigerant from the compressor from flowing to the reheater, and the second heat exchanger uses the refrigerant from the first heat exchanger to cool the air proximate the second heat exchanger.

Certain embodiments provide one or more technical advantages. For example, an embodiment allows overcooled air to be reheated in a controlled manner, thereby improving the comfort of a space. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
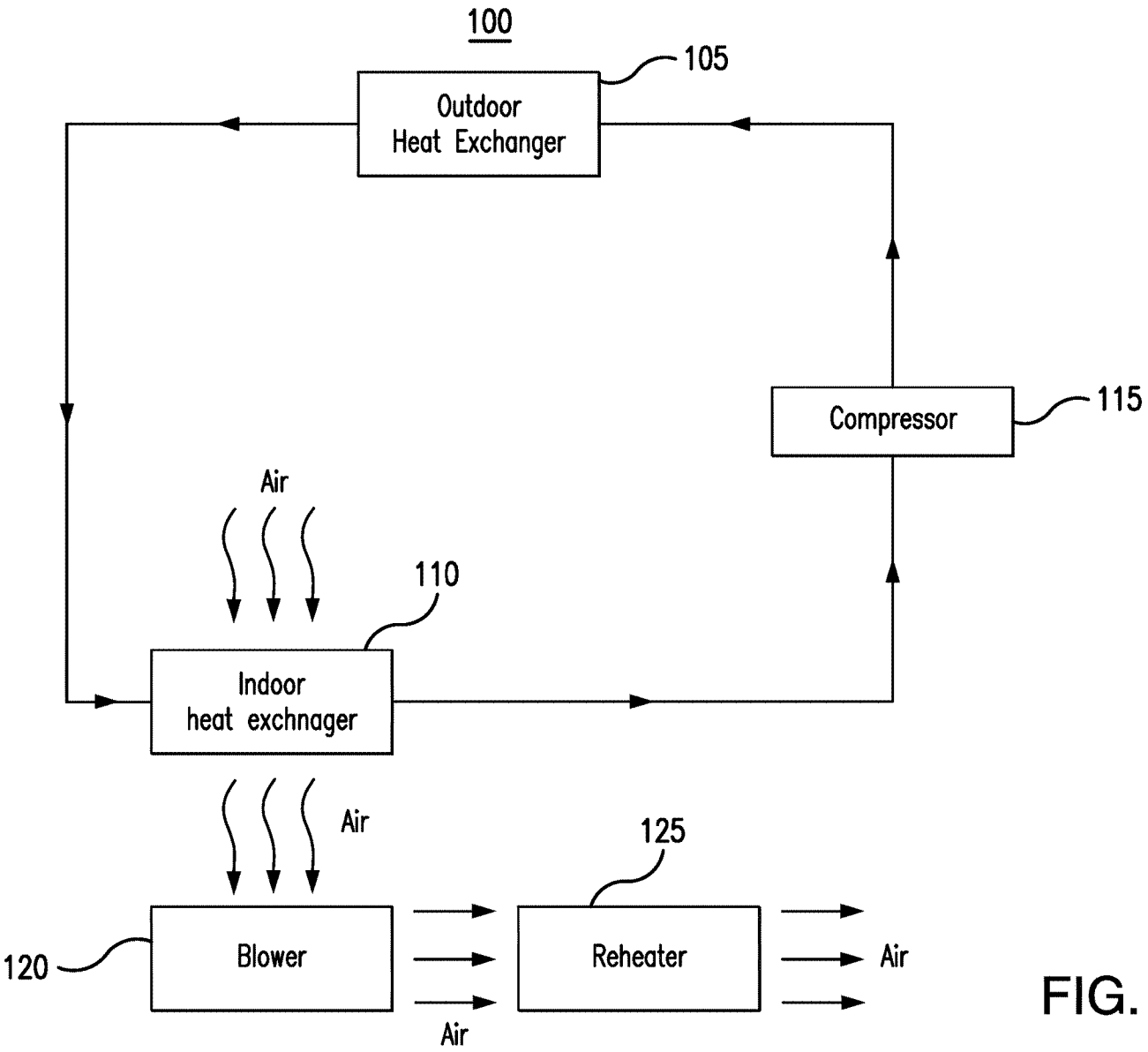
FIG. 1 illustrates an example VRF system with an electric reheater.

Embodiments of the present disclosure and its advantages are best understood by referring to FIGS. 1 through 5 of the drawings, like numerals being used for like and corresponding parts of the various drawings.

Variable refrigerant flow (VRF) systems cycle refrigerant to cool or heat various spaces. For example, a VRF system cycles refrigerant to cool or heat spaces near or around indoor heat exchangers (e.g., evaporators). These heat exchangers include metal components, such as coils, that carry the refrigerant. The refrigerant enters the heat exchangers and absorbs heat from or transfers heat to the air surrounding the heat exchangers, which cools or heats that air. That air is then circulated (e.g., by fan or blower) to various spaces to cool or heat those spaces. Each indoor heat exchanger can be placed in a particular zone (e.g., room) to cool or heat that room. Different indoor heat exchangers in different zones can operate in different modes (e.g., cooling or heating) at the same time.

An outdoor unit that includes an outdoor heat exchanger (e.g., condenser) and a compressor adjusts the heat content in the refrigerant and the flow of the refrigerant depending on the needs of the system. The refrigerant from the indoor heat exchangers is directed through the outdoor unit and back to the indoor heat exchangers. In the outdoor unit, the outdoor heat exchanger and the compressor work to remove heat from or add heat to the refrigerant. The refrigerant is then cycled back to the indoor heat exchanger to cool or heat the space. In certain installations, one outdoor unit can service several indoor heat exchangers that cool or heat different zones. The components of the system (e.g., outdoor heat exchanger, indoor heat exchanger, and compressor) can vary the flow of the refrigerant through the system depending on the cooling and heating needs. For example, if only one zone is active, the refrigerant flow may be low. If several zones are active, the refrigerant flow may increase. In this manner, different zones can be cooled and/or heated without installing duct work throughout a structure.

In some installations, the air that is cooled or heated by the indoor heat exchanger is external air that is supplied to the system. For example, the VRF system may cool or heat air drawn from outside a building and circulate that air throughout the building. At the same time, the VRF system may eject air from inside the building out of the building. In this manner, the air within the building is refreshed and the air pressure within the building is controlled.

In some instances, to control a humidity level within a building or space, the indoor heat exchanger is also used to reduce a humidity level of the external air drawn by the system. For example, the indoor heat exchanger may cool the air to condense water vapor in the air, thereby removing moisture from the air. The more the air is cooled, the more water vapor can be removed from the air. However, in some environments, reducing the humidity level of the air may cause the air to be overcooled. For example, when the temperature of the external air drawn by the system is sufficiently cool, further cooling that air to reduce the humidity level of that air may cause that air to be colder than needed or desired. Circulating that air throughout a space may cause the space to become colder than desired.

In certain installations, the overcooled air is reheated to a suitable or desired temperature before that air is circulated throughout a space. The overcooled air is moved (e.g., by a blower) to a reheater. The reheater may use electric coils or refrigerant from a compressor or outdoor heat exchanger to heat the overcooled air. In these installations, however, it may be difficult to control the amount of reheating that occurs. In some instances, the reheated air may be too hot or too cold for the space. For example, as the same refrigerant flow passes through an indoor heat exchanger and the reheater in series, the net effect of the cooling capacity and heating capacity may cause the supply air to be too cold or too hot from the setpoint (e.g., the ratio of the cooling and heating capacities is fixed, but the supply air setpoint and the ambient may vary, which causes an offset between the supply air temperature and the setpoint). In this case, it is difficult to control the supply air temperature. In other cases, when dehumidification is still needed in mild ambient temperatures, the compressor may reach the low part load limit, the supply air may be too cold, or the reheater air may be too hot for the space.

This disclosure contemplates an unconventional VRF system that reheats overcooled air in a controlled manner. Generally, the VRF system controls a flow of refrigerant to a reheater depending on whether reheating is desired. During a first mode of operation when reheating is desired, a portion of hot refrigerant from a compressor is directed to the reheater, which is then used to heat overcooled air. During a second mode of operation when reheating is not desired, the hot refrigerant from the compressor is directed to an outdoor heat exchanger to remove heat from the refrigerant, as in a regular cooling cycle. The ratio of the two portions of refrigerant flows are regulated by a solenoid valve opening time percentage. In this manner, the reheating of overcooled air is controlled, which improves the comfort level of a space. The VRF system will be described using FIGS. 1 through 5.

FIG. 1 illustrates an example VRF system 100. As seen in FIG. 1, VRF system 100 includes an outdoor heat exchanger 105, an indoor heat exchanger 110, a compressor 115, a blower 120, and a reheater 125. Generally, VRF system 100 cycles a refrigerant to cool air proximate indoor heat exchanger 110. That air may be heated in certain instances and cycled through a space.

Outdoor heat exchanger 105 removes heat from a refrigerant. When heat is removed from the refrigerant, the refrigerant is cooled. This disclosure contemplates outdoor heat exchanger 105 being operated as a condenser and/or a gas cooler. When operating as a condenser, outdoor heat exchanger 105 cools the refrigerant such that the state of the refrigerant changes from a gas to a liquid. When operating as a gas cooler, outdoor heat exchanger 105 cools gaseous refrigerant and the refrigerant remains a gas. In certain configurations, outdoor heat exchanger 105 is positioned such that heat removed from the refrigerant may be discharged into the air. For example, outdoor heat exchanger 105 may be positioned on a rooftop so that heat removed from the refrigerant may be discharged into the air. As another example, outdoor heat exchanger 105 may be positioned external to a building and/or on the side of a building. This disclosure contemplates any suitable refrigerant (e.g., carbon dioxide, R-410A, low-GWP refrigerants, etc.) being used in any of the disclosed VRF systems.

This disclosure contemplates outdoor heat exchanger 105 may be a variable speed outdoor heat exchanger that operates at various speeds depending on the needs of system 100. For example, when the cooling demands of system 100 are great, outdoor heat exchanger 105 may operate at a high speed. When the cooling demands of system 100 are low, outdoor heat exchanger 105 may operate at a low speed.

Refrigerant flows to indoor heat exchanger 110. When the refrigerant reaches indoor heat exchanger 110, the refrigerant removes heat from air around indoor heat exchanger 110. As a result, that air is cooled. The cooled air may then be circulated such as, for example, by a fan or blower, to cool a space, which may be a room of a building. As refrigerant passes through indoor heat exchanger 110, the refrigerant may change from a liquid state to a gaseous state. This disclosure contemplates indoor heat exchanger 110 being any suitable device for transferring heat to the refrigerant. For example, indoor heat exchanger 110 may be an evaporator, a heat exchanger, and/or a coil.

Indoor heat exchanger 110 may receive air external to system 100. For example, indoor heat exchanger 110 may receive air external to a building. This external air may then be cooled and distributed throughout the building. At the same time, air inside the building may be forced out of the building. In this manner, the air within the building is refreshed and the air pressure within the building is controlled.

In certain instances, indoor heat exchanger 110 is used to reduce a humidity level of the external air drawn into the building. Indoor heat exchanger 110 may cool the external air to condense water vapor within the air, thereby reducing the humidity level of the air. In some instances, however, the external air drawn by system 100 may already be sufficiently cool for a space. By further cooling the air to reduce the humidity level of the air, the air may become overcooled. Cycling the overcooled air throughout the space may reduce the temperature of the space to an undesirable level.

This disclosure contemplates indoor heat exchanger 110 may be a variable speed indoor heat exchanger that operates at various speeds depending on the needs of system 100. For example, when the cooling demands of system 100 are great, indoor heat exchanger 110 may operate at a high speed. When the cooling demands of system 100 are low, indoor heat exchanger 110 may operate at a low speed.

Refrigerant may flow from indoor heat exchanger 110 to a compressor 115. This disclosure contemplates system 100 including any number of compressors 115. Compressor 115 may be configured to increase the pressure of the refrigerant. As a result, the heat in the refrigerant may become concentrated and the refrigerant may become a high pressure gas. Compressor 115 may then send the compressed refrigerant to outdoor heat exchanger 105.

This disclosure contemplates that compressor 115 may be a variable speed compressor that operates at various speeds depending on the needs of system 100. For example, when the cooling demands of system 100 are great, compressor 115 may operate at a high speed. When the cooling demands of system 100 are low, compressor 115 may operate at a low speed.

Blower 120 moves air from indoor heat exchanger 110 towards reheater 125. In some instances, blower 120 may further move the air throughout a space to be cooled. Blower 120 may include any suitable component for moving air, such as, for example, a fan, an impellor, a propeller. This disclosure contemplates that the speed of blower 120 may be varied depending on the needs of system 100. For example, when the cooling demands of system 100 are great, blower 120 may operate at a high speed. When the cooling demands of system 100 are low, blower 120 may operate at a low speed.

Reheater 125 heats air from indoor heat exchanger 110. In this manner, reheater 125 increases the temperature of overcooled air from indoor heat exchanger 110 before that air is directed through a space. As a result, the temperature of the space is not reduced to an undesirable level, thereby improving the comfort of the space. In VRF system 100, reheater 125 is an electric heater. Reheater 125 uses electricity to heat metal coils within reheater 125. Air from indoor heat exchanger 110 is moved by blower 120 over these heated coils to increase the temperature of the air. That air is then directed to a space. When the air from indoor heat exchanger 110 does not need to be heated, reheater 125 can be turned off.

Figure 2:
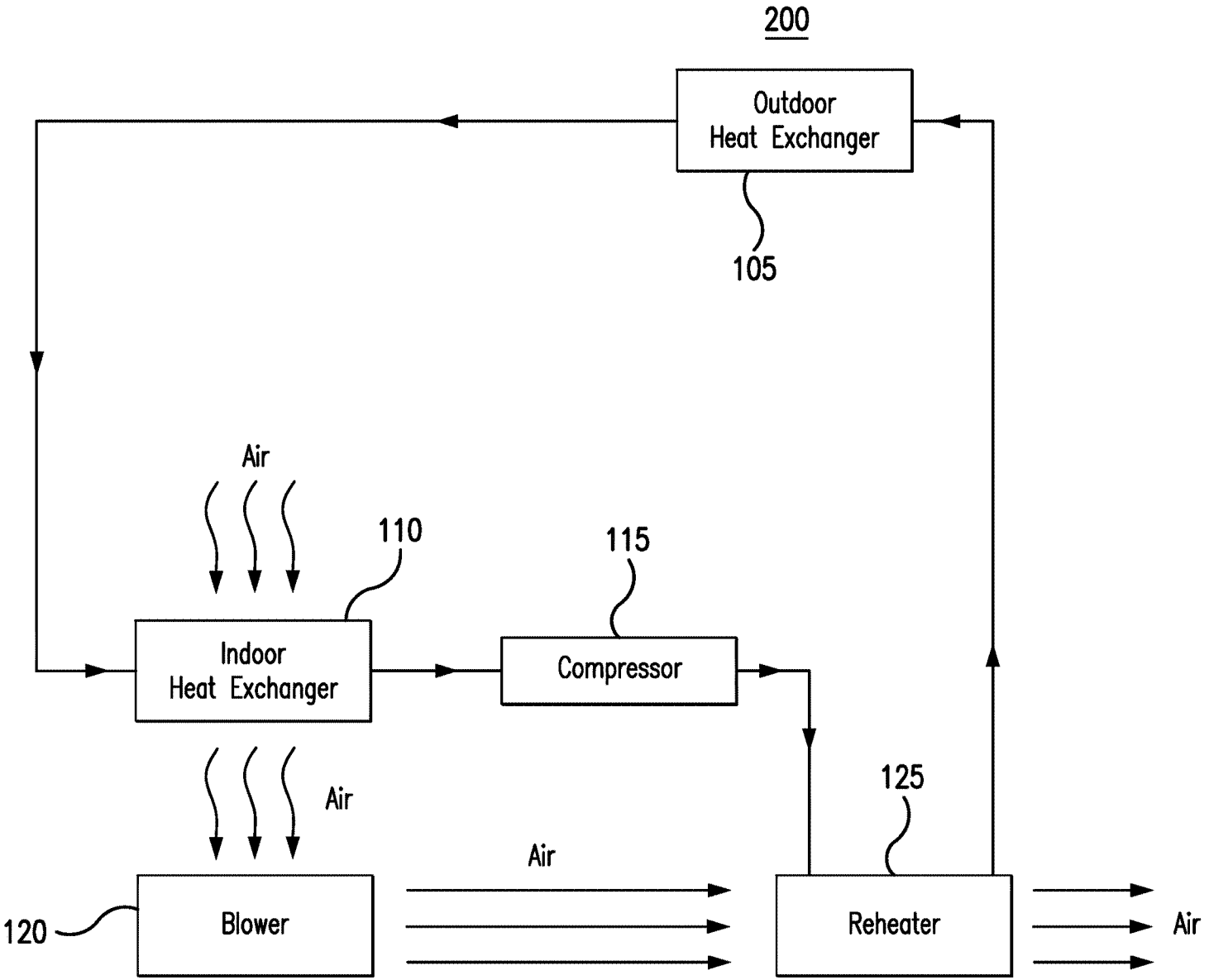
FIG. 2 illustrates an example VRF system with a reheater using compressed refrigerant from an indoor heat exchanger.

FIG. 2 illustrates an example VRF system 200. Generally, VRF system 200 cycles refrigerant to cool air proximate indoor heat exchanger 110. That air may be heated in certain instances and cycled through a space. VRF system 200 operates similarly as VRF system 100. For example, outdoor heat exchanger 105 removes heat from a refrigerant. Indoor heat exchanger 110 uses the refrigerant to cool external air drawn by VRF system 200. Compressor 115 compresses the refrigerant from indoor heat exchanger 110. Blower 120 moves air from indoor heat exchanger 110 to reheater 125. Reheater 125 heats the air moved by blower 120. As seen in FIG. 2, reheater 125 receives refrigerant from compressor 115. Reheater 125 directs that refrigerant to outdoor heat exchanger 105. Outdoor heat exchanger 105 then directs that refrigerant to indoor heat exchanger 110. Indoor heat exchanger 110 then directs that refrigerant to compressor 115.

A significant difference between VRF system 200 and VRF system 100 is that reheater 125 is not an electric reheater. Instead, in VRF system 200, reheater 125 uses refrigerant from compressor 115 to heat air moved by blower 120. In VRF system 200, refrigerant compressed by compressor 115 is first directed to reheater 125 and then to outdoor heat exchanger 105. Reheater 125 may include pipes or coils that receive the refrigerant from compressor 115. Air moved by blower 120 is heated as the air moves over the pipes and coils. The heated air is then directed to a space. Reheater 125 directs the refrigerant to outdoor heat exchanger 105.

Figure 3:
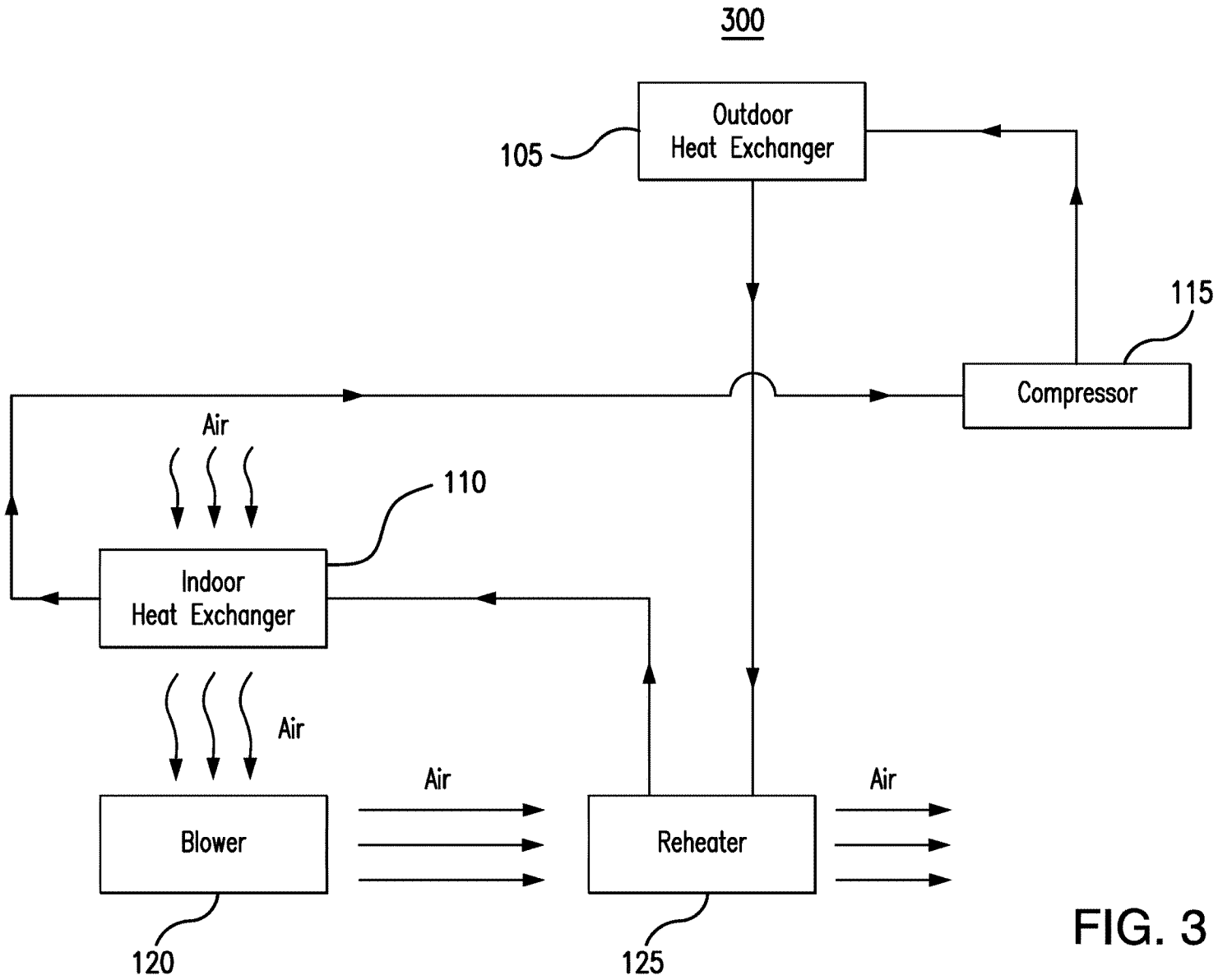
FIG. 3 illustrates an example VRF system with a reheater using refrigerant from an outdoor heat exchanger.

FIG. 3 illustrates an example VRF system 300. Generally, VRF system 300 cycles a refrigerant to cool a space. VRF system 300 operates similarly as VRF system 100. For example, outdoor heat exchanger 105 removes heat from a refrigerant. Indoor heat exchanger 110 uses refrigerant to cool external air drawn by system 300. Compressor 115 compresses refrigerant. Blower 120 moves air from indoor heat exchanger 110 towards reheater 125. Reheater 125 heats air moved by blower 120. As seen in FIG. 3, reheater 125 receives refrigerant from outdoor heat exchanger 105. Reheater 125 directs that refrigerant to indoor heat exchanger 110. Indoor heat exchanger 110 then directs that refrigerant to compressor 115. Compressor 115 then directs that refrigerant to outdoor heat exchanger 105.

A significant difference between VRF system 300 and VRF systems 100 and 200 is that reheater 125 uses refrigerant from outdoor heat exchanger 105 to heat the air moved by blower 120. Reheater 125 includes pipes and/or coils that receive refrigerant from outdoor heat exchanger 105. Air is moved over these pipes or coils by blower 120 to increase the temperature of the air. That air is then directed through a space.

Although VRF systems 100, 200, and 300 use reheater 125 to heat air before that air is distributed to a space, it may be difficult to control the amount of heat transferred to that air. For example, VRF system 100 uses electric coils to heat the air but because the electric coils are either on or off, it is difficult to control the temperature of the electric coils, and, thus, the amount of heat transferred to the air. VRF systems 200 and 300 use refrigerant to heat the air but because of the configuration of VRF systems 200 and 300, the flow of the refrigerant through reheater 125 is not controlled. As a result, the amount of heat transferred to the air becomes difficult to control. In some instances, the air distributed to the space by VRF systems 100, 200, and 300 may be too hot or too cold for the space. For example, the air may be hotter or cooler than desired.

Figure 4A:
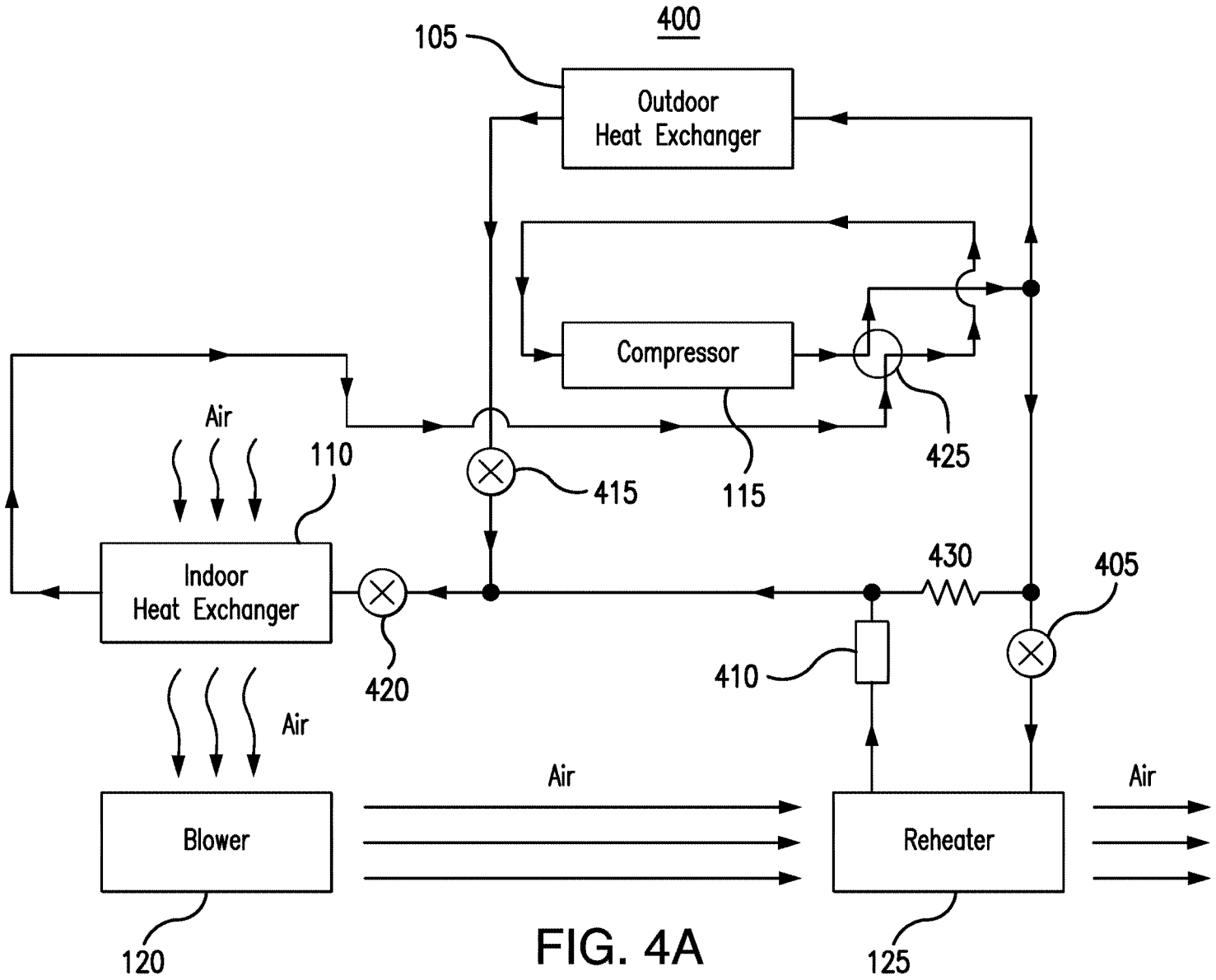
FIG. 4A illustrates an example VRF system configured for operation in a cooling mode.

FIG. 4A illustrates an example VRF system 400 in cooling mode. Generally, VRF system 400 heats air in a controlled manner before distributing that air to a space. As seen in FIG. 4A, VRF system 400 includes, an outdoor heat exchanger 105, an indoor heat exchanger 110, a compressor 115, a blower 120, a reheater 125, a valve 405, a flow restrictor 410, a valve 415, a valve 420, a valve 425, and a cap tube 430. In particular embodiments, VRF system 400 improves the comfort of a space by heating air in a controlled manner before distributing that air throughout the space.

The components of VRF system 400 operate similarly as they did in VRF system 100. For example, outdoor heat exchanger 105 removes heat from a refrigerant. Indoor heat exchanger 110 cools external air drawn by VRF system 400. Compressor 115 compresses refrigerant. Blower 120 moves air from indoor heat exchanger 110 towards reheater 125. Reheater 125 heats air moved by blower 120.

The configuration of VRF system 400 allows reheater 125 to heat air in a controlled manner. Generally, reheater 125 uses refrigerant from compressor 115 to heat air moved by blower 120. Certain components of VRF system 400 control the flow of the refrigerant to reheater 125 such that air is heated in a controlled manner.

Valve 405 controls a flow of refrigerant from compressor 115 to reheater 125. In some embodiments, valve 405 is a solenoid valve. Valve 405 can be opened or closed to control a flow of refrigerant from compressor 115 to reheater 125. When air moved by blower 120 needs to be heated, valve 405 can be opened to allow refrigerant from compressor 115 to flow to reheater 125. That refrigerant then supplies heat to the air. The colder the air from blower 120 is, the more valve 405 can be opened to allow more refrigerant from compressor 115 to flow to reheater 125 in certain embodiments. As a result, more heat is transferred to the air before the air is directed to the space. When the air no longer needs to be heated, valve 405 can be closed to prevent refrigerant from compressor 115 from flowing to reheater 125. When valve 405 is closed, air moved by blower 120 is still moved towards reheater 125, but the air is no longer heated by reheater 125 before being directed to a space.

Only a portion of the refrigerant from compressor 115 is directed through valve 405 to reheater 125 when valve 405 is open. The remaining portion of the refrigerant from compressor 115 is directed to outdoor heat exchanger 105. In certain embodiments, the portion of the refrigerant directed from compressor 115 to outdoor heat exchanger 105 is larger than the portion of the refrigerant directed from compressor 115 through valve 405 to reheater 125. When valve 405 is closed, the refrigerant from compressor 115 is directed to outdoor heat exchanger 105 and not reheater 125.

Flow restrictor 410 controls a flow of the refrigerant from reheater 125 to indoor heat exchanger 110. Flow restrictor 410 may be any suitable valve that controls or limits the flow of a fluid throw flow restrictor 410. Generally, flow restrictor 410 reduces the amount of flow fluctuation caused by the opening and/or closing of valve 405. As a result, flow restrictor 410 prevents and/or inhibits sudden increases and/or decreases of refrigerant flow from reheater 125 to indoor heat exchanger 110 (e.g., when valve 410 is first opened or closed).

Valves 415 and 420 control a flow of refrigerant to indoor heat exchanger 110. Valve 415 controls a flow of refrigerant from outdoor heat exchanger 105 to indoor heat exchanger 110. Valve 420 controls a flow of refrigerant from indoor heat exchanger 105 and reheater 125 to indoor heat exchanger 110. When valves 415 and 420 are opened, refrigerant flows through valves 415 and 420. When valves 415 and 420 are closed, refrigerant stops flowing through valves 415 and 420. In certain embodiments, valves 415 and 420 can be opened to varying degrees to adjust the amount of flow of refrigerant. For example, valves 415 and 420 may be opened more to increase the flow of refrigerant. As another example, valves 415 and 420 may be opened less to decrease the flow of refrigerant. In certain instances, valve 415 also works with a fan in outdoor heat exchanger 105 to raise the condensing pressure in low part load conditions, which reduces the cooling capacity and increases the heating capacity relatively. The ratio change reduces the overcool degree and eases the control.

In certain embodiments, valves 415 and 420 are thermal expansion valves. Expansion valves are used to cool refrigerant flowing through the expansion valves. Expansion valves may receive refrigerant from any component of a VRF system, such as for example outdoor heat exchanger 105 and/or reheater 125. Expansion valves reduce the pressure and therefore the temperature of the refrigerant. Expansion valves reduce pressure from the refrigerant flowing into the expansion valves. The temperature of the refrigerant may then drop as pressure is reduced. As a result, refrigerant entering the expansion valves may be cooler when leaving the expansion valves.

Valve 425 controls a flow of refrigerant between indoor heat exchanger 110 and compressor 115. In certain embodiments, valve 425 is a four-way valve that can direct refrigerant from indoor heat exchanger 110 to compressor 115, and vice versa. In this manner, system 400 may operate as a cooling system or as a heating system. In the example of FIG. 4A, valve 425 is configured such that refrigerant flows from indoor heat exchanger 110 to compressor 115 in a cooling mode. The heating mode configuration will be explained using FIG. 4B.

The operation of VRF system 400 in a cooling mode may be summarized as below: compressor 115 compresses a refrigerant. At this point, VRF system 400 determines whether air should be heated before being directed into a space. For example, if the temperature of external air drawn into VRF system 400 is below a threshold or if the temperature of air moved by blower 120 towards reheater 125 is below a threshold, then the air should be heated by reheater 125 before that air is directed into a space.

If air should be heated before being directed to a space, then a first mode of operation may be performed to heat the air. Valve 405 may open to allow a portion of the refrigerant from compressor 115 to flow towards reheater 125. The remaining portion of the refrigerant from compressor 115 flows to outdoor heat exchanger 105, where heat is removed from that refrigerant. Reheater 125 uses the portion of the refrigerant from compressor 115 to heat the air from blower 120 before that air is directed to the space. The refrigerant is then directed from reheater 125 to indoor heat exchanger 110. Additionally, refrigerant from outdoor heat exchanger 105 is directed to indoor heat exchanger 110. Indoor heat exchanger 110 uses the refrigerant from outdoor heat exchanger 105 and reheater 125 to cool external air drawn by VRF system 400. The cool air is then directed by blower 120 towards reheater 125. Indoor heat exchanger 110 then directs refrigerant to compressor 125.

If air does not need to be heated before being directed into the space, then a second mode of operation may be performed. Valve 405 may close to prevent refrigerant from flowing from compressor 115 to reheater 125. As a result, compressor 115 directs refrigerant to outdoor heat exchanger 105. Outdoor heat exchanger 105 removes heat from the refrigerant and directs the refrigerant to indoor heat exchanger 110. Indoor heat exchanger 110 uses the refrigerant to cool external air drawn by VRF system 400. Blower 120 moves the cooled air to reheater 125. Because no refrigerant is flowing through reheater 125, the air is not heated before being directed into the space. Indoor heat exchanger 110 directs the refrigerant to compressor 115.

This disclosure contemplates system 400 transitioning between the first mode of operation and the second mode of operation depending on the temperature of the air moved by system 400. For example, if the temperature of the external air drawn by system 400 is below a temperature threshold or if the temperature of the air moved by blower 120 is below a temperature threshold, then system 400 may transition from the second mode of operation to the first mode of operation to heat that air. Conversely, if the temperature of the external air drawn by system 400 is above a temperature threshold or if the temperature of the air moved by blower 120 is above a temperature threshold, then system 400 may transition from the first mode of operation to the second mode of operation to stop heating that air.

This disclosure contemplates that any component may be used to detect the temperature of air and to transition system 400 between modes of operation. For example, a temperature sensor may be used to detect a temperature of air. A processor, controller, and/or thermostat may be used to transition system 400 between modes of operation.

In this manner, VRF system 400 heats air in a controlled manner thereby improving the comfort of a space. For example, air directed into the space may be heated such that the air is not colder or hotter than desired.

Figure 4B:
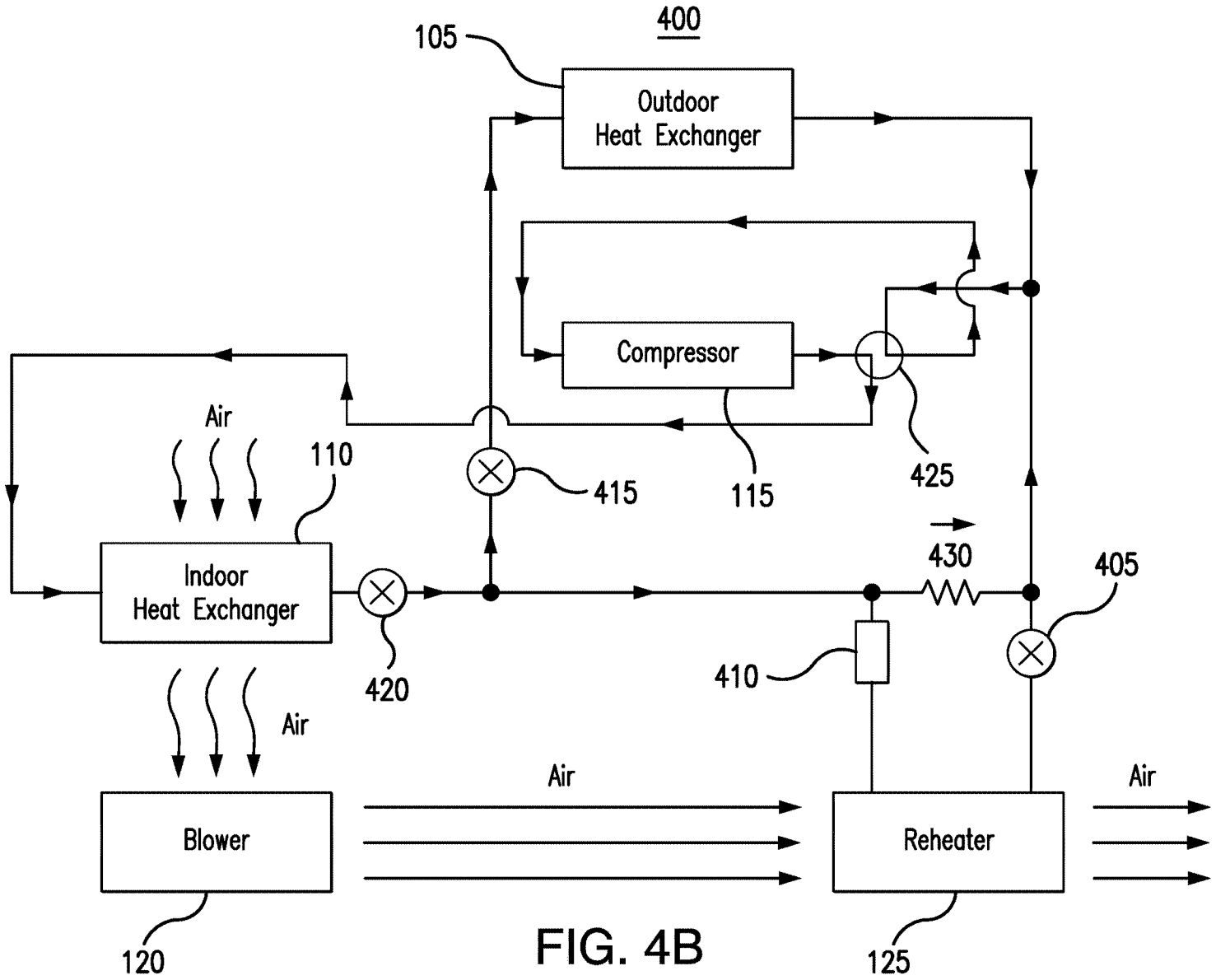
FIG. 4B illustrates an example VRF system configured for operation in a heating mode.

FIG. 4B illustrates the example VRF system 400 in heating mode. To transition system 400 from cooling mode (as shown in FIG. 4A) to heating mode (as shown in FIG. 4B), valve 425 is adjusted so that the flow of refrigerant in system 400 is generally reversed. As seen in FIG. 4B, valve 425 is configured such that refrigerant flows from compressor 115 through valve 425 to indoor heat exchanger 110. Refrigerant from indoor heat exchanger 110 flows through valves 420 and 415 to outdoor heat exchanger 105. A portion of the refrigerant from indoor heat exchanger 110 may flow towards flow restrictor 410. In that instance, cap tube 430 allows liquid refrigerant to bypass flow restrictor 410, reheater 125, and valve 405. This prevents liquid refrigerant from accumulating in reheater 125, which avoids other components of system 400 (e.g., compressor 115, outdoor heat exchanger 105, and indoor heat exchanger 110) from being short on refrigerant. The refrigerant from outdoor heat exchanger 105 and the refrigerant from cap tube 430 is then directed to valve 425 and back to compressor 115.

Figure 5:
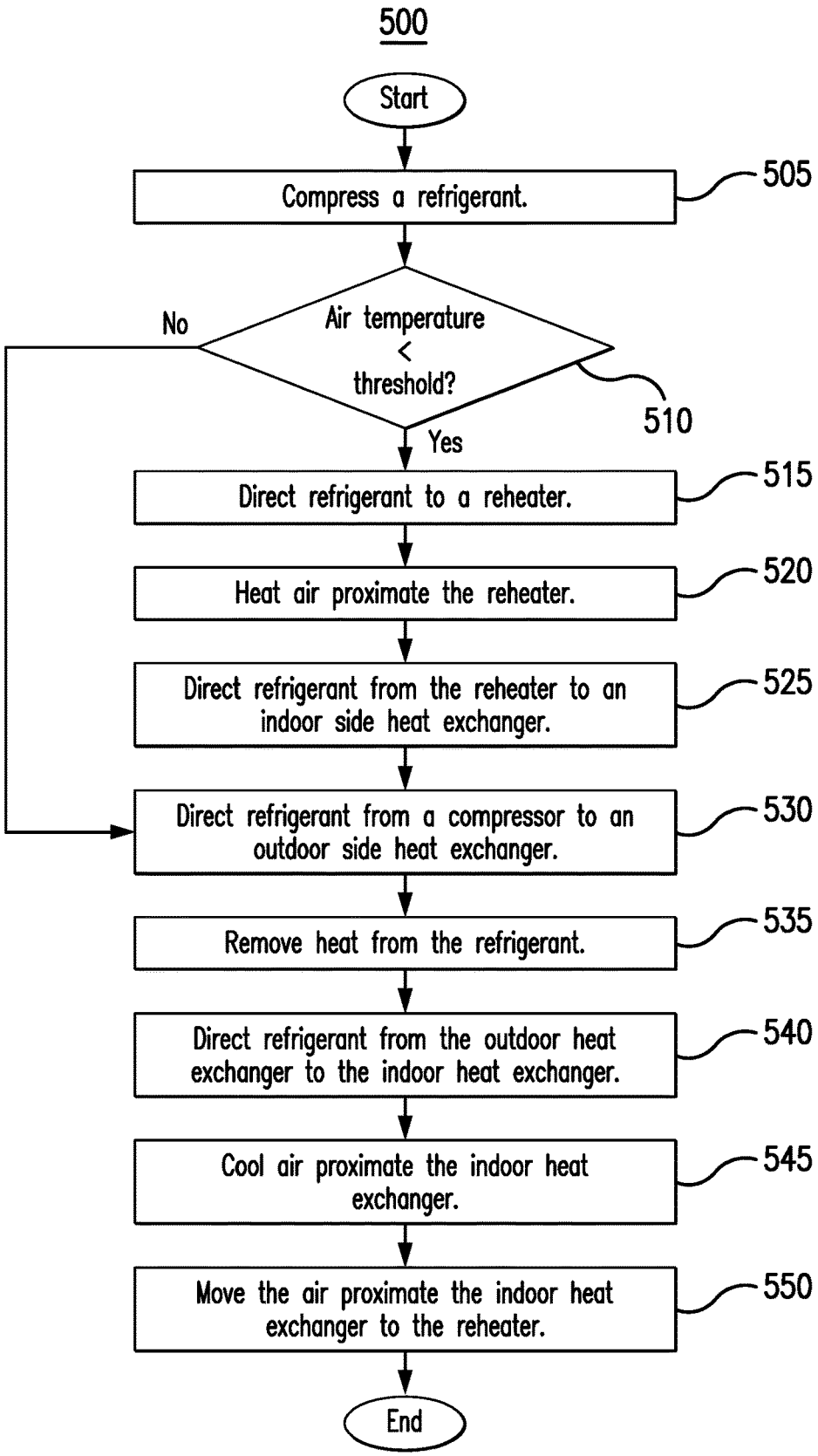
FIG. 5 is a flowchart illustrating a method of operating the example VRF system of FIG. 4A.

FIG. 5 is a flowchart illustrating a method 500 of operating the example VRF system of FIG. 4. Generally, the components of VRF system 400 perform the steps of method 500. In particular embodiments, by performing method 500, the comfort of a space is improved by heating air in a controlled manner before that air is directed into the space.

In step 505, an outdoor heat exchanger compresses a refrigerant. In step 510, it is determined whether an air temperature is less than a threshold. In certain embodiments, a temperature sensor, processor, controller, and/or thermostat may be involved in performing step 510. In some embodiments, the measured air temperature is the temperature of the external air drawn by the VRF system. In other embodiments, the measured temperature of the air is the temperature of the air moved by a blower towards a reheater. By measuring the temperature of the air, the system can determine whether the air is overcooled (e.g., when the air is further cooled to dehumidify the air).

If the temperature of the air is the below the threshold, then the air should be heated before being directed to a space. In step 515, refrigerant from a compressor is directed to a reheater. The reheater uses that refrigerant to heat the air proximate the reheater in step 520. In step 525, the reheater directs the refrigerant to an indoor heat exchanger. In this manner, the reheater uses refrigerant from a compressor to heat air proximate the reheater before the air is directed to a space.

If air does not need to be reheated or if air has been reheated, the compressor directs refrigerant to an outdoor heat exchanger in step 530. If the air has been reheated, then the compressor directs only a portion of the refrigerant to outdoor heat exchanger in step 530. In step 535, the outdoor heat exchanger removes heat from the refrigerant. The outdoor heat exchanger directs the refrigerant to the indoor heat exchanger in step 540. In step 545, the indoor heat exchanger uses the refrigerant to cool air proximate the indoor heat exchanger. A blower moves the air proximate the indoor heat exchanger to the reheater in step 550.

Modifications, additions, or omissions may be made to method 500 depicted in FIG. 5. Method 500 may include more, fewer, or other steps. For example, steps may be performed in parallel or in any suitable order. While discussed as system 400 (or components thereof) performing the steps, any suitable component of system 400 may perform one or more steps of the method 500.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the compressor, the refrigerant from the load, the refrigerant from the outdoor heat exchanger, etc.). When such terminology is used, this disclosure is not limiting the described refrigerant to being directly from the particular component. This disclosure contemplates refrigerant being from a particular component (e.g., the outdoor heat exchanger) even though there may be other intervening components between the particular component and the destination of the refrigerant.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a compressor configured to compress a refrigerant;

a first heat exchanger;

a reheater;

a first valve;

a second heat exchanger;

a four-way valve;

a cap tube; and a blower configured to move air proximate the second heat exchanger to the reheater, during a first mode of operation:

the first heat exchanger configured to remove heat from a first portion of the refrigerant from the compressor;

the first valve configured to open such that a second portion of the refrigerant from the compressor flows to the reheater;

the second heat exchanger configured to use the first portion of the refrigerant from the first heat exchanger and the second portion of the refrigerant from the reheater to cool air proximate the second heat exchanger; and the reheater configured to use the second portion of the refrigerant from the compressor to heat the air moved by the blower;

during a second mode of operation:

the first heat exchanger configured to remove heat from the refrigerant from the compressor;

the first valve configured to close to prevent refrigerant from the compressor from flowing to the reheater; and the second heat exchanger configured to use the refrigerant from the first heat exchanger to cool the air proximate the second heat exchanger; and during a heating mode of operation:

the four-way valve configured to direct refrigerant from the compressor to the second heat exchanger;

the second heat exchanger configured to use the refrigerant from the compressor to heat air proximate the second heat exchanger; and the cap tube configured to allow refrigerant to bypass the reheater.

2. The apparatus of claim 1, further comprising a flow restrictor configured to control a flow of the second portion of the refrigerant from the reheater to the second heat exchanger.

3. The apparatus of claim 1, wherein the second heat exchanger is further configured to reduce a humidity level of the air when the second heat exchanger cools the air.

4. The apparatus of claim 1, wherein the first mode of operation transitions to the second mode of operation when a temperature of the air proximate the second heat exchanger is above a threshold.

5. The apparatus of claim 1, wherein the first portion of the refrigerant is larger than the second portion of the refrigerant.

6. A method comprising:

compressing, by a compressor, a refrigerant;

during a first mode of operation:

removing, by a first heat exchanger, heat from a first portion of the refrigerant from the compressor;

opening a first valve such that a second portion of the refrigerant from the compressor flows to a reheater;

using, by a second heat exchanger, the first portion of the refrigerant from the first heat exchanger and the second portion of the refrigerant from the reheater to cool air proximate the second heat exchanger;

moving, by a blower, air proximate the second heat exchanger to the reheater; and using, by the reheater, the second portion of the refrigerant from the compressor to heat air moved by the blower;

during a second mode of operation:

removing, by the first heat exchanger, heat from the refrigerant from the compressor;

closing the first valve to prevent refrigerant from the compressor from flowing to the reheater;

using, by the second heat exchanger, the refrigerant from the first heat exchanger to cool the air proximate the second heat exchanger; and moving, by the blower, air proximate the second heat exchanger to the reheater;

and during a heating mode of operation:

adjusting a four-way valve to direct refrigerant from the compressor to the second heat exchanger;

using, by the second heat exchanger, the refrigerant from the compressor to heat air proximate the second heat exchanger; and allowing, by a cap tube, refrigerant to bypass the reheater.

7. The method of claim 6, further comprising controlling, by a flow restrictor, a flow of the second portion of the refrigerant from the reheater to the second heat exchanger.

8. The method of claim 6, further comprising, reducing, by the second heat exchanger, a humidity level of the air when the second heat exchanger cools the air.

9. The method of claim 6, further comprising transitioning from the first mode of operation to the second mode of operation when a temperature of the air proximate the second heat exchanger is above a threshold.

10. The method of claim 6, wherein the first portion of the refrigerant is larger than the second portion of the refrigerant.

11. The method of claim 6, wherein a speed of a flow of the refrigerant through one or more of the compressor, first heat exchanger, and second heat exchanger is variable.

12. A system comprising:

a compressor configured to compress a refrigerant;

a first heat exchanger;

a reheater;

a first valve;

a second heat exchanger;

a four-way valve; and a cap tube;

during a first mode of operation:

the first heat exchanger configured to remove heat from a first portion of the refrigerant from the compressor;

the first valve configured to open such that a second portion of the refrigerant from the compressor flows to the reheater;

the second heat exchanger configured to use the first portion of the refrigerant from the first heat exchanger and the second portion of the refrigerant from the reheater to cool air proximate the second heat exchanger; and the reheater configured to use the second portion of the refrigerant from the compressor to heat the air cooled by the second heat exchanger; and during a second mode of operation:

the first heat exchanger configured to remove heat from the refrigerant from the compressor;

the first valve configured to close to prevent refrigerant from the compressor from flowing to the reheater; and the second heat exchanger configured to use the refrigerant from the first heat exchanger to cool the air proximate the second heat exchanger; and during a heating mode of operation:

the four-way valve configured to direct refrigerant from the compressor to the second heat exchanger;

the second heat exchanger configured to use the refrigerant from the compressor to heat air proximate the second heat exchanger; and the cap tube configured to allow refrigerant to bypass the reheater.

13. The system of claim 12, further comprising a flow restrictor configured to control a flow of the second portion of the refrigerant from the reheater to the second heat exchanger.

14. The system of claim 12, wherein the second heat exchanger is further configured to reduce a humidity level of the air when the second heat exchanger cools the air.

15. The system of claim 12, wherein the first mode of operation transitions to the second mode of operation when a temperature of the air proximate the second heat exchanger is above a threshold.

16. The system of claim 12, wherein the first portion of the refrigerant is larger than the second portion of the refrigerant.

* * * * *